US005678868A

United States Patent [19]

Williams et al.

[11] Patent Number: 5,678,868

[45] Date of Patent: Oct. 21, 1997

[54] ELECTRONIC DOOR LOCKING MECHANISM

[76] Inventors: Gary Lin Williams, 428 E. Third Ave., Kennewick, Wash. 99336; Patrick Gerald Kirby, 1010 W. Fifteenth Pl., Kennewick, Wash. 99337

[21] Appl. No.: 563,491

[22] Filed: Nov. 28, 1995

[51] Int. Cl.[6] ..... E05C 1/06

[52] U.S. Cl. ..... 292/144; 70/278; 70/280; 292/169.14

[58] Field of Search ..... 292/144, 142, 292/172, 169.14, 169.17, DIG. 37; 70/149, 153, 278, 280, DIG. 73, 156

[56] References Cited

U.S. PATENT DOCUMENTS

| | | | |
|---|---|---|---|
| 3,893,723 | 7/1975 | Boule | 292/144 |
| 4,135,377 | 1/1979 | Kleedfeldt et al. | 70/280 X |
| 4,148,092 | 4/1979 | Martin | 70/149 X |
| 4,519,640 | 5/1985 | Mombelli | 292/33 |
| 4,637,237 | 1/1987 | Witkoski et al. | 70/156 X |
| 4,691,542 | 9/1987 | Young | 70/280 |
| 4,799,719 | 1/1989 | Wood | 292/144 |
| 4,904,005 | 2/1990 | Frolov | 292/144 X |
| 5,033,282 | 7/1991 | Gartner et al. | 70/278 |
| 5,339,662 | 8/1994 | Goldman | 70/278 |
| 5,513,510 | 5/1996 | Solovieff et al. | 292/169.14 X |
| 5,540,068 | 7/1996 | Gartner et al. | 70/278 X |

FOREIGN PATENT DOCUMENTS

| | | | |
|---|---|---|---|
| 2686115 | 7/1993 | France | 292/169.14 |

*Primary Examiner*—Rodney M. Lindsey
*Assistant Examiner*—Monica E. Millner
*Attorney, Agent, or Firm*—Veo Peoples, Jr.; J. William Stader; B. Hudson, Jr.

[57] ABSTRACT

The invention is a motorized linkage for engaging a thumb piece in a door mechanism. The device has an exterior lock assembly with a small battery cell and combination lock. Proper entry by a user of a security code allows the battery to operate a small motor within the exterior lock assembly. The small motor manipulates a cam-plunger which moves an actuator pin into a thumb piece. The user applies a force on to the thumb piece. This force is transmitted by the thumb piece to a latch engagement mechanism by the actuator pin. The latch engagement mechanism operates the door latch.

6 Claims, 3 Drawing Sheets

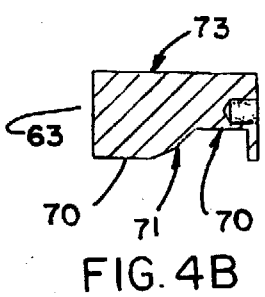
FIG. 4B
FIG. 4A
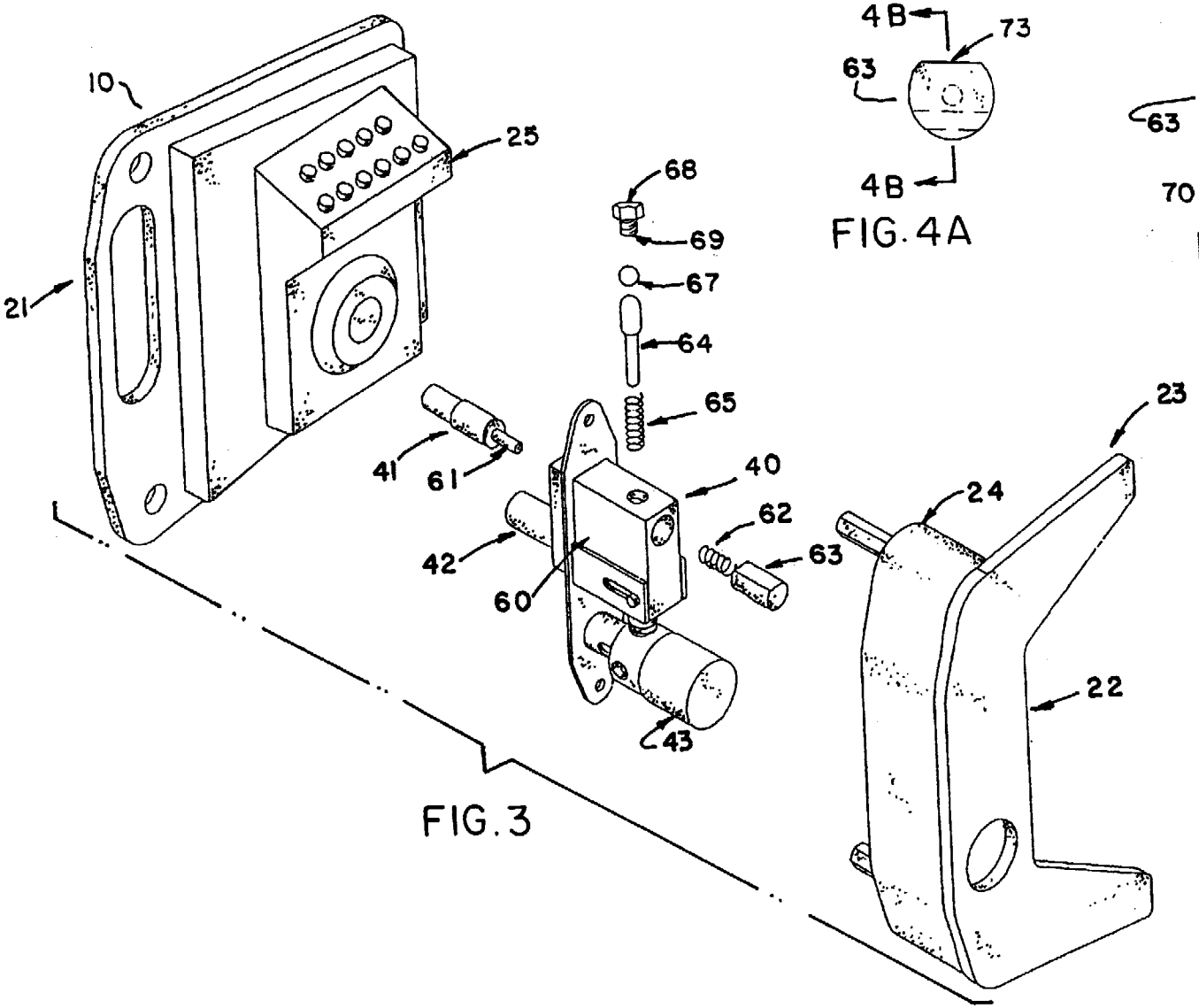
FIG. 3

ELECTRONIC DOOR LOCKING MECHANISM

The U.S. government has a paid-up license in this invention and the right in limited circumstances to require the patent owner to license others on reasonable terms as provided for by the terms of contract No. DE-AC06-87RL10930 awarded by the United States Department of Energy.

BACKGROUND OF THE INVENTION

1. Field of the Invention

This invention relates to the field of electrical locks used in entry and exit passages in controlled access areas.

2. Description of Prior Art

Locks were originally of an entirely mechanical design. Electrically-controlled locks were later developed because of their ability to efficiently add, delete, and document specific lock users. Early electrically-controlled locks utilized large solenoids or electric motors that required connection to the local power grid for sufficient power.

More recently, electrically-controlled locks, powered by small batteries contained within the locks, have been developed. To date, these designs have not addressed a special segment of locks, specifically, exit devices.

Exit devices are locks designed to allow "one-motion", unimpeded evacuation out a door in the event of fire or other emergency. A design which would provide an electrically-controlled entrance function, powered by internally held batteries, to an exit device would be a tremendous advance over the existing art.

Two primary design requirements exist for electrically controlled locks powered by internally held batteries. First, the design must be mechanically efficient to control mechanical parts, capable of withstanding a forced entry attempt, while utilizing a minimal amount of electrical power. Second, the design must accommodate mis-timed or abusive operation by the lock user without becoming inoperable.

An additional design criteria would be a lock that accommodates an existing exit device design.

The prior art illustrates a variety of patents which attempt to overcome the need for greater power consumption or damage to the linkage by improper usage.

U.S. Pat. No. 3,893,723 (Boule) relates to an electromagnetically operated door lock. The locking device includes a housing 7 to which is secured a hollow cylindrical member 8. A locking pin slides through the member 8, which member 8 is also provided with two longitudinal bores that receive a pin actuating member 10. An end of member 10 is attached to a plunger 11 belonging to a first magnetic solenoid actuator 12 and the other end is attached to a plunger 13 of a second magnetic solenoid actuator 12'. The member 10 is driven by one or the other of the solenoid actuators 12/12'. Unfortunately, the use of a solenoid actuator greatly increases the power and expense aspects of this device.

U.S. Pat. No. 4,148,092 (Martin) relates to an electronic battery operated door lock. This patent discloses a keyboard 15 having push buttons 16, the keyboard 15 being mounted on a door adjacent to a turning knob 14. A microprocessor 19 includes a comparator means connected to the keyboard 15. A solenoid plunger 20 is also provided that is received in a cavity 24 when a plunger 20 is in a first position. Cavity 24 is formed in the turning knob 14. An enabling signal from the comparator causes the plunger 20 to move to a second position and out of the cavity 24, which, in turn, releases the shaft to permit manual turning of the shaft by turning the turning knob 14. Similar to the Boule device, this invention uses an expensive solenoid which must be connected to a larger power source.

U.S. Pat. No. 4,519,640 (Mombelli) relates to an electronically motorized lock controlled by a coded signal. This patent discloses a control module 1 connected to a lock "V", which is, in turn, attached to a plate 13. A motor 2 is secured to the plate 13. The shaft of the motor 2 includes a lead-screw 4 on which a nut 5 is shifted. As the lead-screw 4 is rotated in one direction by motor 2, the nut 5 moves from the rear to the front of the lock and bolts 7 driven by member 6 move outwardly to an unlocking position. As the lead-screw 4 is rotated in the reverse direction, the nut 5 is shifted from the front toward the rear of the lock and the bolts 7 move inwardly to a locking position. A magnetic reversing switch 10 allows the lock to be automatically closed. The use of screws increases the load of the electric motor and hence requires a larger motor or the motor will have to be replaced more frequently.

U.S. Pat. No. 4,799,719 (Wood) relates to electrical locks. This patent discloses a lock "L" used to lock a door 10. A frame 18 mounted in the wall surrounding door 10 includes a member 36 having a through-hole and a nut 20 attached to a member 36. A motor 14 is slidably attached to frame 18 and has a shaft 17 having a threaded portion 22 to mate with the nut 20 and a smooth portion 24 that is inserted into a door cavity 28. When motor 17 is energized, output shaft 17 rotates which causes motor 14 and its shaft 17 to slide along frame 18 to alternately engage and disengage the smooth portion 24 with the door 10 to respectively lock and unlock the door. Similar to the Mombelli, the engagement of the motor in this disclosure will result in greater loads being placed on the motor.

U.S. Pat. No. 4,904,005 (Frolov) relates to a door security system utilizing an electromagnetic locking device. This patent discloses a doorway 10 defined by frames 11 and 12 and a soffit member 13. The magnet may be energized by a battery 38. In series with the battery 38 is a card reader **34*b*, a latchbolt switch 22, and a reed switch 21. Entry through doorway 10 is authorized when card reader 34*b* recognizes the card fed into it. During authorized entry, switch 34*b* is opened to allow the authorized person to turn a handle 19*a*. However, during an attempted unauthorized entry, turning handle 19*a* closes switch 22 to complete a circuit through battery 38 and the electromagnet 14** to lock the door. Thus, the electromagnet is not energized unless unauthorized entry is attempted. This apparatus would consume larger amounts of electricity to maintain and could fail during a power outage.

European patent no. 219-694 (Ilco Unican, Inc.) relates to a lock actuator assembly using a card reader to control a solenoid blocking pin that engages a clutch in a door knob. Unfortunately, the solenoid would require a large energy source.

French patent no. 2616-172-A relates to an electromechanical lock using coding buttons and has opposing springs for bolt movement, the springs being manually preloaded but electromagnetically releases to move the bolt. This apparatus would require fine tolerance which would increase its costs. Further a device of such high tolerances probably could not survive repeated use in a typical environment.

OBJECTS OF THE INVENTION

It is an object of the present invention to provide an electric, motorized door lock linkage which minimizes the use of electrical power.

It is a further object of the present invention to provide an apparatus with a linkage which minimizes the amount of load placed on the electrical motor.

It is a further object of the present invention to provide an electric, motorized door lock linkage which cannot be tampered with.

It is a further object of the present invention to provide an electric, motorized door lock linkage which is impervious to timing errors which may damage the electric motor or the lock linkage.

It is a further object of the present invention to provide an electric, motorized entrance function, powered by internally held batteries, to an exit device.

SUMMARY OF THE INVENTION

The present invention is an apparatus which overcomes the deficiencies in the prior art by extending the benefits of a battery-powered, electrically-controlled entrance function to an exit device.

The invention is an electrically-operated, motorized linkage for controlling a lock in a controlled access facility.

A small lithium battery cell operates a small motor after the correct security code is inserted. The motor moves a cam-plunger which inserts an actuator pin into the thumb piece. Once the actuator pin is inserted into the thumb piece an individual can press down on the thumb piece. The energy provided by the individual is transferred to withdraw the exit device door latch. By using the electric motor to only move the actuator pin into the thumb piece a much smaller power source and motor can be used. The design of the cam-plunger as well as the use of a coil-spring between the motor and cam-plunger greatly minimizes the load on the electric motor. Additionally, the placement of a bearing in proximity to the actuator pin and the use of a hex screw base on the cam-plunger further reduces the load on the motor and linkage. The design of the cam-plunger, timing of the motor and use of a spring-biased actuator pin prevents tampering and linkage timing errors.

BRIEF DESCRIPTION OF THE DRAWINGS

FIG. 3 is an exploded isometric view of the general elements of the present invention.

FIG. 4A is a front view of the cam-plunger of the present invention.

FIG. 4B is a side view of the cam-plunger of the present invention.

DETAILED DESCRIPTION OF THE INVENTION

Figure 2:
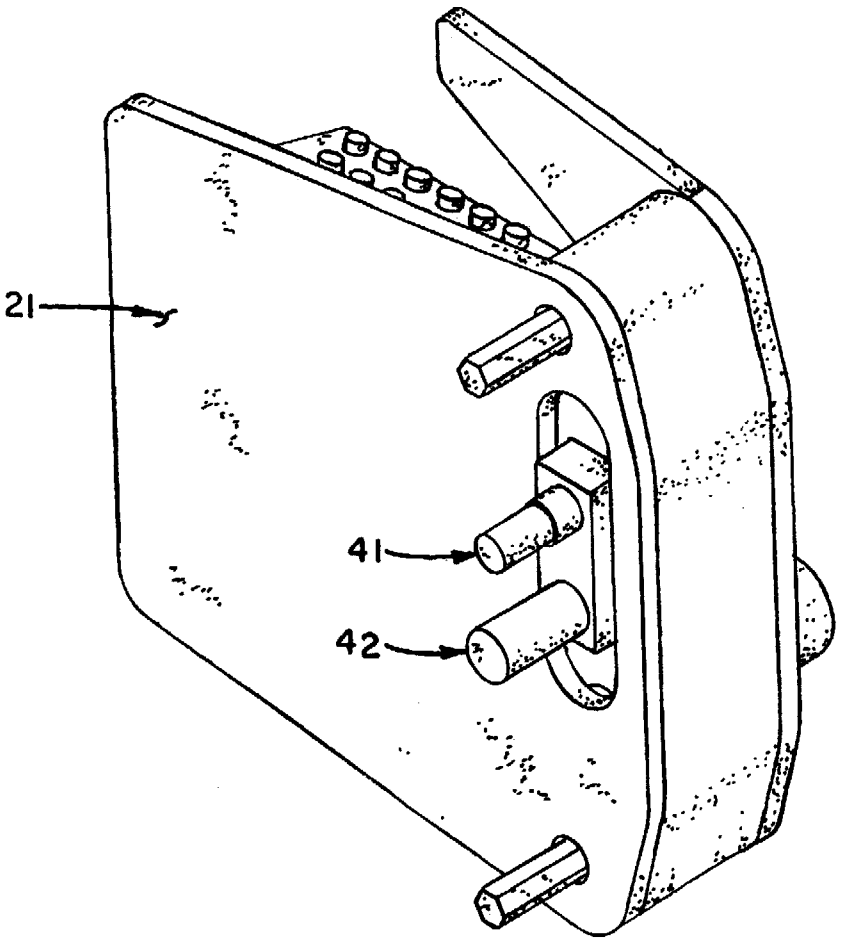
FIG. 2 is a side view which illustrates the back of the exterior housing of the present invention.
Figure 1:
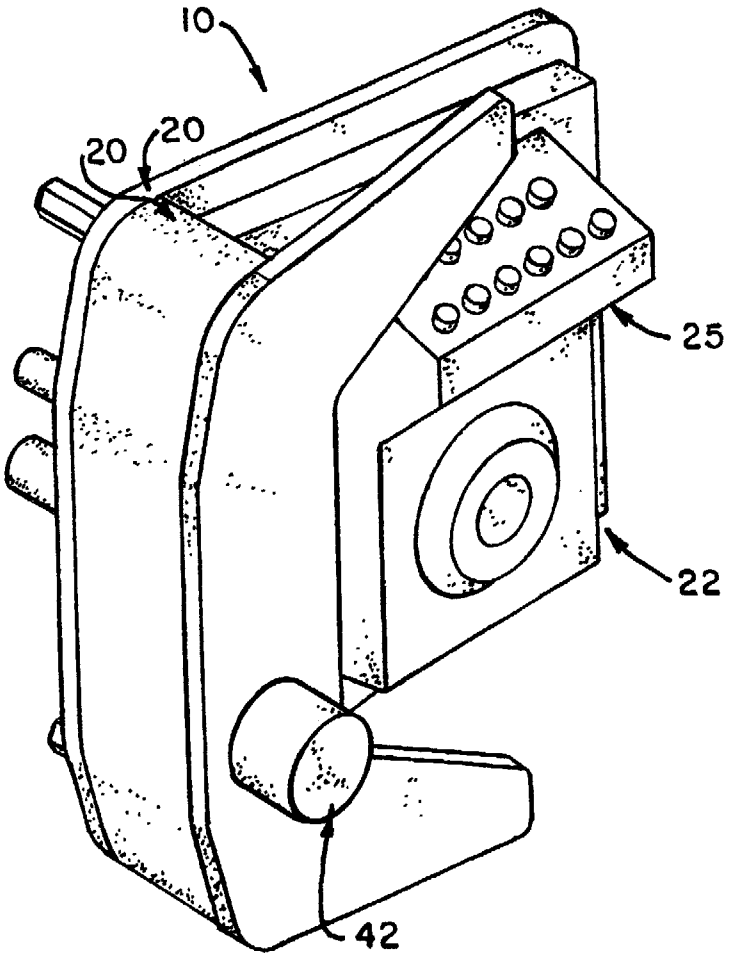
FIG. 1 is a side view which illustrates the front of the exterior housing of the present invention.
Figure 5:
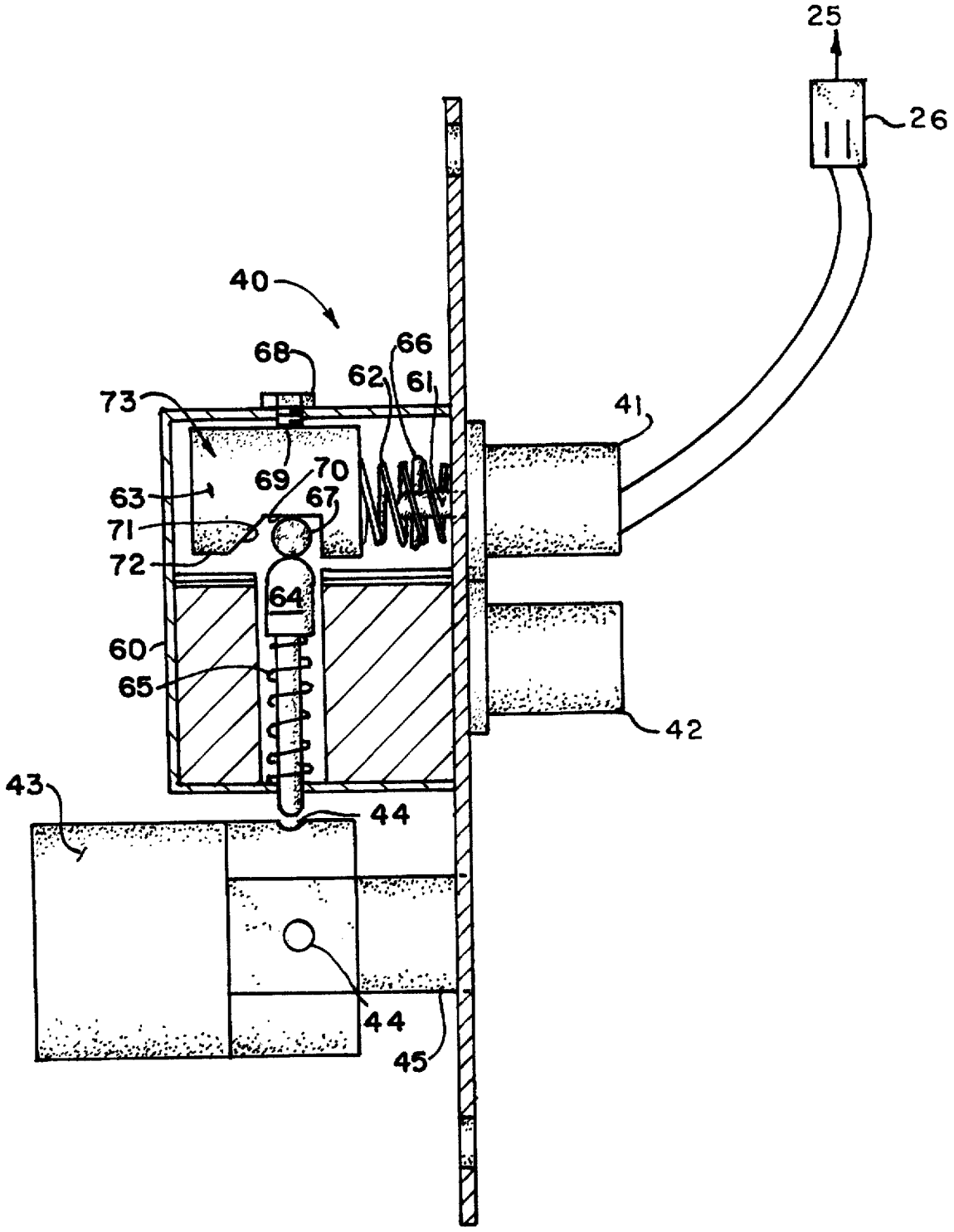
FIG. 5 is a partial cut-away view of the block sub-assembly of the present invention.

Referring the figures, it is possible to view the various major elements constituting the present invention (10). An exterior lock assembly (20) contains the block sub-assembly (40). Within the block sub-assembly (40) in the cam block assembly (60). While the advantages and operational details of the invention will be discussed later, a brief discussion of the operation of the device may be initially helpful.

An individual desiring entry into a controlled area provides the necessary combination to the combination means (25) located on the front (22) of the exterior lock assembly (20). This allows a battery (26) to operate a small motor (41) in the block sub-assembly (40). The energy of the motor ultimately forces an actuator pin (64) into the thumb piece (42). The individual depresses the thumb piece (42) and pulls on the door pull (23), thus opening the door.

The exterior lock assembly (20) consists of back (21) which is mounted on a door and a front (22). Located on the front (22) is the combination means (25), the door pull (23) and the trim housing (24). Contained within the trim housing is the block sub-assembly (40). The combination means (25) is a conventional code mechanism designed to allow electricity from the battery (26) to flow to the motor (41).

The block sub-assembly (40) consists of a thumb piece (43), the motor (41), cam block assembly (60) and latch engagement shaft (42). The thumb piece protrudes through an opening in the door pull (23). At the base of the thumb piece are the actuator pin receiving slot (44). The thumb piece slides on the thumb piece shaft (45). The motor (41) is connected to the battery (26). The motor is, typically, powered by a 6-volt battery pack, completes approximately 12 rotations per command, and may undergo gear reduction via an attached transmission. In an alternative embodiment, the motor speed can be adjusted by hollowing out a portion of the cam-plunger so that the coil spring is affixed within the cam-plunger. This would allow for a different motor or coil spring length, if so desired. The latch engagement shaft 42 receives the kinetic energy supplied by the user via the thumb piece (43).

The cam block assembly (60) consists of the shaft (61), coil spring (62), cam-plunger (63), the actuator pin (64), the actuator pin spring (65), the coil spring attachment pin (66), a bearing, and a hex screw (68). The shaft (61) is affixed to the motor (41). The shaft's first end has the coil spring attachment pin (66) attached. The shaft's second end is affixed to turn with the motor. The coil spring (62) engages the coil spring attachment pin (66) at its first end and is secured to the cam-plunger (63) with a machine screw at the second end. The cam-plunger (63) has an upper planar region (73) which is in contact with the flat base (69) of the hex screw (68). Within the cam-plunger (63) there are a series of angled surfaces for controlling the motion and speed of the actuator pin ((64) through a camming action. The open region or camming surface (70) is horizontal, the 45° region (71) and the top region (72) which is also horizontal. Into these regions or camming surfaces (70, 71 and 72) is placed a lubricated or teflon-coated ball bearing (67). Beneath the ball bearing (67) is the actuator pin (65). When a correct security code is entered, the actuator pin is inserted into a actuator pin receiving slot (44) located on the thumb piece (43).

The operation of the present invention is as follows. First, a user correctly inputs a security code into the combination means (25), thus allowing power to flow from the small battery source. The preferred embodiment uses two 3-volt lithium batteries or four 1.5-volt AA alkaline batteries. This allows the motor shaft (61) and coil spring attachment pin (66) to engage the coil spring (62). This pulls the coil spring (62) and the cam-plunger towards the motor (41). The movement of the cam-plunger camming surfaces (70, 71, 72) in turn displaces the ball bearing (67). The movement of the ball bearing moves the actuator pin (64) into an actuator pin receiving slot (44) on the thumb piece (43). The user then depresses the thumb piece (43). The kinetic energy applied by the user to move the thumb piece (43) is transferred to the latch engagement shaft (42) via the actuator pin (64). The latch engagement shaft (42) extends through the door and withdraws the exit device latch. After an interval of time (5 seconds in the preferred embodiment), the motor (41) reverses. This reversal moves the cam-plunger (63) away from the motor. The ball bearing is re-inserted into the cam-plunger open slot (70). This results in the actuator pin (64) being withdrawn from the actuator pin receiving slot located on the thumb piece.

There are several advantages to using the above configuration. First, the coil spring and ball bearing minimize the load on the electric motor. The less load placed on the motor allows this part to function for longer periods of time. The use of a spring and ball bearing allows for minor mis-alignments which in a screw-type or pivot-type linkage damages the motor. Further limiting the motor load is the base (69) of the hex screw (68) in contact with the planar region (73) of the cam-plunger (63). The base (69) acts as a bearing on the cam-plunger.

To avoid damage to the motor by mis-alignment, several features are present. First, the planar region of the cam-plunger limits the rotational movement of the cam-plunger. Second, the slopes in the cam-plunger slot (70, 71 and 72) control the speed and movement of the actuator pin (65). Third, the actuator pin spring (65) assists in controlling the motion of the actuator pin.

Finally, because the cam-plunger, the ball bearing, and the actuator pin are not held in a fixed relationship to each other, through means of screw or pivot-type linkages, mis-timed operation of the thumb piece or motor by users does not adversely affect the operation or durability as the mechanism.

Further, the actuator pin spring (65) also acts to prevent the an intruder from forcing the actuator pin into the actuator pin receiving slot. Some intruders have attempted to circumvent the security system by hitting the upper portion of the exterior lock assembly (20) while holding the thumb piece. A proper blow, previously, could have allowed the actuator pin to drop into the thumb piece. The actuator pin spring prevents this from occurring.

It will be obvious to those skilled in the art that various changes may be made without departing from the scope of the invention and the invention is not to be considered limited to what is illustrated in the drawings and described in the specification.

What is claimed is:

1. An electronic door locking mechanism, comprising:

a) an exterior lock assembly having a trim housing, a door pull connected to the trim housing, a combination means for receiving an input unlocking code electrically connected to a battery means for supplying electrical power, said trim housing having an interior for supporting a block sub-assembly, said door pull having an opening therein for receiving a thumb piece connected to the block sub-assembly;

b) said block sub-assembly having a cam-block assembly connected to a latch engagement shaft, a motor electrically connected to the combination means and mechanically connected to the cam-block assembly, said thumb piece having a plurality of actuator pin receiving slots, said thumb piece and slots slidably mounted on a thumb piece shaft and said thumb piece inserted through the door pull opening; and c) said cam-block assembly having a shaft with a first end and a second end, said second end affixed to the motor, said first end having a coil spring attachment pin, a coil spring with a first end and second end, said second end of the coil spring attached to the attachment pin, a cam-plunger affixed to the first end of the coil spring, said cam-plunger in contact with a bearing, said bearing positioned on a first end of an actuator pin, a second end of the actuator pin disposed to be moved into a single actuator pin receiving slot on the thumb piece upon rotation of the shaft by the motor which laterally displaces the cam-plunger, wherein the second end of the actuator pin is engaged in said receiving slot such that a kinetic force may be transferred from the thumb piece to the latch engagement shaft by the actuator pin unlocking the electronic door mechanism.

2. An electronic door locking mechanism as recited in claim 1, wherein the cam-plunger therein further comprises:

a) a upper planar region in slidable contact with a hex screw base;

b) the cam-plunger having a camming surface, therein with an open region, a flat region connected by a 45° region, said slot for receiving the bearing.

3. An electronic door locking mechanism as recited in claim 2, wherein the actuator pin therein further comprises an actuator pin spring surrounding the actuator pin.

4. An electronic door locking mechanism as recited in claim 3, wherein said motor is electrically powered by a 6-volt battery pack.

5. An electronic door locking mechanism as recited in claim 4, wherein said battery means further comprises a battery source selected from a group consisting of two 3-volt lithium batteries and four 1.5-volt AA alkaline batteries.

6. An electronic door locking mechanism as recited in claim 4, wherein said bearing is a teflon-coated bearing surrounded by a lubricate.

* * * * *